US010964498B2

(12) United States Patent
Galletti et al.

(10) Patent No.: US 10,964,498 B2
(45) Date of Patent: Mar. 30, 2021

(54) GAS-INSULATED LOW- OR MEDIUM-VOLTAGE LOAD BREAK SWITCH

(71) Applicant: ABB Schweiz AG, Baden (CH)

(72) Inventors: Bernardo Galletti, Nussbaumen (CH); Elham Attar, Porsgrunn (NO); Jan Carstensen, Waldshut-Tiengen (DE); Magne Saxegaard, Porsgrunn (NO); Martin Kristoffersen, Porsgrunn (NO); Martin Seeger, Oberentfelden (CH); Michael Schwinne, Ehrendingen (CH); Nitesh Ranjan, Niederrohrdorf (CH); Patrick Stoller, Illnau (CH)

(73) Assignee: ABB Schweiz AG, Baden (CH)

( * ) Notice: Subject to any disclaimer, the term of this patent is extended or adjusted under 35 U.S.C. 154(b) by 89 days.

(21) Appl. No.: 16/207,946

(22) Filed: Dec. 3, 2018

(65) Prior Publication Data

US 2019/0115174 A1 Apr. 18, 2019

Related U.S. Application Data

(63) Continuation of application No. PCT/EP2017/063474, filed on Jun. 2, 2017.

(30) Foreign Application Priority Data

Jun. 3, 2016 (EP) ..... 16172827

(51) Int. Cl.
*H01H 33/12* (2006.01)
*H01H 33/56* (2006.01)
(Continued)

(52) U.S. Cl.
CPC ..... *H01H 33/7023* (2013.01); *H01H 9/52* (2013.01); *H01H 33/121* (2013.01);
(Continued)

(58) Field of Classification Search
CPC .. H01H 33/7032; H01H 33/121; H01H 33/56; H01H 33/703; H01H 33/7038; H01H 33/88; H01H 33/91; H01H 9/52
(Continued)

(56) References Cited

U.S. PATENT DOCUMENTS 4,553,008 A * 11/1985 Veverka ..... H01H 33/88 218/117
4,829,150 A * 5/1989 Sasamori ..... H01H 33/7069 218/62
(Continued)

FOREIGN PATENT DOCUMENTS

CN 1299144 A 6/2001
CN 1308353 A 8/2001
(Continued)

OTHER PUBLICATIONS

Chinese Patent Office, Second Office Action issued in corresponding Application No. 201780048315.5, dated Nov. 25, 2019, 15 pp.
(Continued)

*Primary Examiner* — William A Bolton
(74) *Attorney, Agent, or Firm* — Taft Stettinius & Hollister LLP

(57) ABSTRACT

A gas-insulated low- or medium-voltage load break switch includes: a housing defining a housing volume for holding an insulation gas at an ambient pressure; a first arcing contact and a second arcing contact arranged within the housing volume, the first and second arcing contacts being movable in relation to each other along an axis of the load break switch and defining a quenching region in which an arc is formed during a current breaking operation; a pressurizing system having a pressurizing chamber arranged within the housing volume for pressurizing a quenching gas from an ambient pressure $p_0$ to a quenching pressure $p_{quench}$ during the current breaking operation; and a nozzle system
(Continued)

arranged within the housing volume for blowing the pressurized quenching gas in a subsonic flow pattern from the pressurization chamber onto the arc formed in the quenching region during the current breaking operation. The nozzle system includes at least one nozzle arranged for blowing the quenching gas from an off-axis position predominantly radially inwardly onto the quenching region.

24 Claims, 3 Drawing Sheets

(51) Int. Cl.
*H01H 33/70* (2006.01)
*H01H 33/88* (2006.01)
*H01H 33/91* (2006.01)
*H01H 9/52* (2006.01)

(52) U.S. Cl.
CPC ..... *H01H 33/56* (2013.01); *H01H 33/703* (2013.01); *H01H 33/7038* (2013.01); *H01H 33/88* (2013.01); *H01H 33/91* (2013.01); *H01H 2033/566* (2013.01)

(58) Field of Classification Search
USPC ..... 218/1, 51, 53, 57, 62–64, 72
See application file for complete search history.

(56) References Cited

U.S. PATENT DOCUMENTS

| | | | | |
|---|---|---|---|---|
| 5,126,516 | A * | 6/1992 | Thuries | H01H 33/98 218/62 |
| 5,155,314 | A * | 10/1992 | Dufournet | H01H 33/91 218/63 |
| 5,293,014 | A * | 3/1994 | Perret | H01H 33/905 218/57 |
| 2001/0002664 | A1 | 6/2001 | Stechbarth et al. | |
| 2001/0002665 | A1 | 6/2001 | Claessens et al. | |

FOREIGN PATENT DOCUMENTS

| | | | |
|---|---|---|---|
| CN | 103794423 | A | 5/2014 |
| CN | 104488058 | A | 4/2015 |
| EP | 1916684 | A1 | 4/2008 |
| EP | 2958124 | A1 | 12/2015 |
| RU | 2006976 | C1 | 1/1994 |
| RU | 2091891 | C1 | 9/1997 |
| RU | 2121187 | C1 | 10/1998 |
| RU | 2148281 | C1 | 4/2000 |
| RU | 2207648 | C1 | 6/2003 |
| WO | 8404201 | A1 | 10/1984 |
| WO | 2013153110 | A1 | 10/2013 |
| WO | 2014096460 | A1 | 6/2014 |
| WO | 2015039918 | A1 | 3/2015 |
| WO | 2015177149 | A1 | 11/2015 |

OTHER PUBLICATIONS

European Patent Office, International Preliminary Report on Patentability issued in corresponding Application No. PCT/EP2017/063474, dated May 11, 2018, 20 pp.
European Patent Office, International Search Report & Written Opinion issued in corresponding Application No. PCT/EP2017/063474, dated Oct. 9, 2017, 14 pp.
European Patent Office, Extended Search Report issued in corresponding Application No. 16172827.4, dated Nov. 8, 2016, 6 pp.
First Office Action issued in corresponding Chinese application No. 201780048315.5, dated Jun. 3, 2019, 26 pp.
Russian Patent Office, Office Action issued in corresponding Application No. 2018146062/07(076999), dated Jun. 4, 2020, 12 pp.
European Patent Office, Extended Search Report issued in corresponding Application No. 20189405.2, dated Dec. 14, 2020, 8 pp.
Indian Patent Office, Examination Report issued in corresponding Application No. 201847045523, dated Dec. 18, 2020, 6 pp.

* cited by examiner

GAS-INSULATED LOW- OR MEDIUM-VOLTAGE LOAD BREAK SWITCH

TECHNICAL FIELD

Aspects of the present invention generally relate to a gas-insulated low-voltage or medium-voltage load break switch (LBS) with arc-extinguishing capability, to a distribution network, ring main unit (RMU), or secondary distribution gas-insulated switchgear having such a load break switch, to a use of such a load break switch in a distribution network, and to a method of breaking a load current using the load break switch.

BACKGROUND ART

Load break switches (LBS) constitute an integral part of the gas-insulated ring main units assigned to the task of switching load currents in a range of 400 A-2000 A (rms). When switching a current, the switch is opened by relative movement of the contacts (plug and tulip) away from each other, whereby an arc may form between the separating contacts.

A traditional load break switch typically uses a knife switch or, in more advanced designs, a mechanism (e.g. a puffer mechanism) to cool and extinguish the arc. In load break switches with a puffer mechanism, quenching gas is compressed in a compression (puffer) volume and released, through the center of the tulip, towards the arc for extinguishing the arc. An example of this flow is shown in FIG. 4 and described in more detail below.

Typically, $SF_6$ is used as the quenching gas because of its excellent dielectric and cooling properties. Low interruption current, coupled with the efficient cooling properties of $SF_6$ allow for a relatively low pressure build-up for interrupting the arc in LBS, which enables a low-cost solution for the drive and the overall design of the traditional load breaker.

WO 2013/153110 A1 discloses a high-voltage gas circuit breaker, which is designed to interrupt short-circuit currents in a range of tens of kiloamperes at high voltages above 52 kV, For this purpose, the circuit breaker has an extinguishing-gas pressurization system, which includes a piston-driven pressurization chamber and/or a self-blasting heating chamber that is or are fluidally connected via a heating channel to a nozzle system providing a nozzle constriction or nozzle throat to confine the arc-blowing gas and to accelerate it above the speed of sound. Such circuit breakers are used in high-voltage transmission systems, and in particular in high-voltage substations (air-insulated or dielectric-gas-insulated switchgear assemblies).

Circuit breakers are in contrast to load break switches that e.g. form part of ring main units (RMUs, so-called secondary medium voltage equipment), which are designed for distributing electric energy at relatively low rated currents of several 100 A and at relatively low rated voltages up to e.g. 36 kV or up to 24 kV or up to 12 kV. The load break switch can switch-off only nominal load currents and only up to typically 2 kiloamperes at most.

EP 2 958 124 A1 discloses an arc-extinguishing insulating material molding and a gas circuit breaker using same.

EP 1 916 684 A1 discloses a gas-insulated high-voltage circuit breaker having a nozzle with a first throat and a second throat for providing locally subsonic flow, followed by a nozzle diffusor part for providing strong supersonic gas expansion.

WO 84/04201 discloses an SF6-gas load break switch for distribution voltages, which has a piston and nozzle system for arc blowing. Therein, the rapid motion of the piston generates a blow of insulating gas through holes in the piston for directing the gas around first ends of the contact rods and through the nozzle to quench the arc. Due to high speed operation of the breaker drive and hence piston motion, due to hermetic sealing and due to the small diameter of the SF6-gas load break switch, high gas pressures and thus supersonic flow conditions are are generated.

SUMMARY OF THE INVENTION

An object of the invention is to provide an improved a gas-insulated low- or medium-voltage load break switch, which allows for reliable arc extinction even under difficult conditions, while still maintaining at least to some extent a relatively low-cost and compact design.

In view of the above, a gas-insulated low- or medium-voltage load break switch according to claim 1, a distribution network, ring main unit of secondary distribution gas-insulated switchgear (GIS) according to claim 19 comprising such a load break switch, a method of breaking a load current according to claim 20, and a use of such a load break switch according to claim 24 are provided.

According to a first aspect of the invention, a gas-insulated low- or medium-voltage load break switch is provided. As defined herein, a load break switch has a capability to switch load currents, but does not have a short-circuit-current interrupting capability. The load currents are also referred to as rated currents or nominal currents and may for example be up to 2000 A, preferably up to 1250 A or more preferably up to 1000 A, which are typical rated currents used in distribution networks, ring main units, and secondary distribution gas-insulated switchgear (GIS). The rated currents may on the other hand be more than 1 A, more preferably more than 100 A, more preferably more than 400 A. In case of an AC load breaker, the rated current is herein indicated in terms of the rms current.

Herein, a low or medium voltage is defined as a voltage of up to at most 52 kV. The low- or medium-voltage load break switch therefore has a rated voltage of at most 52 kV. The rated voltage may, in particular, be at most 52 kV, or preferred at most 36 kV, or more preferred at most 24 kV, or most preferred at most 12 kV. The voltage rating may be at least 1 kV. The load break switch comprises a housing (gas enclosure) defining a housing volume for holding an insulation gas at an ambient pressure $p_0$ (rated operating pressure of the load break switch, i.e. ambient pressure present inside the load break switch under steady-state conditions); a first arcing contact (e.g. pin contact) and a second arcing contact (e.g. tulip contact) arranged within the housing volume, the first and second arcing contacts being movable in relation to each other along an axis of the load break switch and defining a quenching region in which an arc is formed during a current breaking operation; a pressurizing system (e.g. buffer system) having a pressurizing chamber arranged within the housing volume for pressurizing a quenching gas (which may be just pressurized insulation gas) to a quenching pressure $p_{quench}$ during the current breaking operation, wherein the quenching pressure $p_{quench}$ satisfies the condition $p_0<p_{quench}$, and in particular $p_{quench}<1.8*p_0$, wherein $p_0$ is an ambient pressure; and a nozzle system arranged within the housing volume for blowing the pressurized quenching gas in a subsonic flow pattern from the pressurization chamber onto the arc formed in the quenching region during the current breaking operation. Whether the flow pattern is supersonic or subsonic depends on the pressure difference between the quenching pressure $p_{quench}$ and the ambient pressure $p_0$. As defined herein, a subsonic flow pattern is present, in particular under the condition that $p_{quench}<1.8*p_0$.

According to a further aspect of the present invention, there is provided a method of breaking a load current using the load break switch described herein. The method comprises moving the first arcing contact and the second arcing contact relatively away from each other along the axis of the load break switch, whereby an arc is formed in the quenching region; pressurizing the quenching gas to the quenching pressure $p_{quench}$ satisfying the condition $p_0<p_{quench}$, wherein $p_0$ is an ambient pressure; and blowing, by the nozzle system, the pressurized quenching gas in a subsonic flow pattern from the pressurization chamber onto the arc formed in the quenching region, thereby blowing the quenching gas from an off-axis position predominantly radially inwardly onto the quenching region.

In embodiments of the method, the subsonic flow pattern is maintained during the whole current breaking operation; and/or the subsonic flow pattern is maintained during all types of current breaking operations; and/or the subsonic flow pattern is maintained inside the the load break switch, in particular inside the nozzle system or inside the at least one nozzle; and/or sonic flow conditions are avoided at any instant of the current breaking operation and for every current breaking operation to be performed by the load break switch.

Further advantages, features, aspects and details that can be combined with embodiments described herein and are disclosed in the dependent claims and claim combinations, in the description and in the drawings.

BRIEF DESCRIPTION OF THE DRAWINGS

The invention will be explained in greater detail with reference to the accompanying drawings, wherein.

DESCRIPTION OF PREFERRED EMBODIMENTS

Figure 1A:
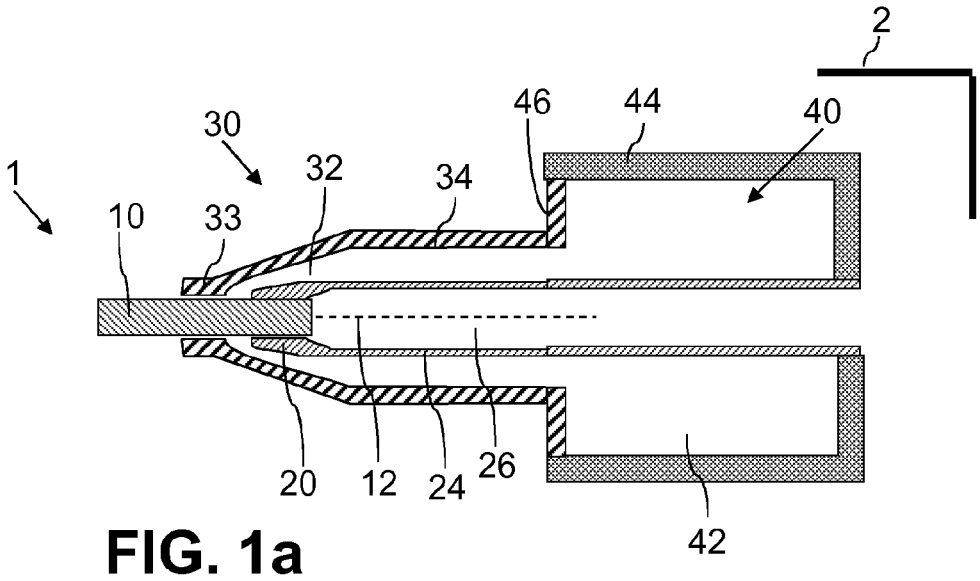
FIGS. 1*a*-1*c* show a cross-sectional view of a load break switch according to an embodiment of the invention in various states during a current breaking operation.

Reference will now be made in detail to the various aspects and embodiments. Each aspect and embodiment is provided by way of explanation and is not meant as a limitation. For example, features illustrated or described as part of one aspect or embodiment can be used on or in conjunction with any other aspect or embodiment. It is intended that the present disclosure includes such combinations and modifications.

According to an aspect of the invention, the nozzle system comprises at least one nozzle arranged for blowing the quenching gas from an off-axis position predominantly radially inwardly onto the quenching region. The off-axis position of the at least one (or of each) nozzle is at a predetermined distance from the axis, with the predetermined distance being e.g. at least the inner diameter of the second (tulip) contact. The at least one nozzle may be arranged radially outside of the first (pin) or second (tulip) contact.

In an aspect of the invention, the nozzle system defines a flow pattern for the quenching gas, the flow pattern including a stagnation point at which the flow of quenching gas substantially stops, an upstream region (i.e. upstream of the stagnation point in a flow direction of the quenching gas) of predominantly radially inward flow towards the stagnation point, and a downstream region (i.e. downstream of the stagnation point in a flow direction of the quenching gas) of accelerating flow in a predominantly axial direction away from the stagnation point.

Herein, a predominantly radially inward flow is a flow that comes from a nozzle outlet, which is offset with respect to a center axis of the switch, i.e. such that the nozzle outlet opening does not have (or all nozzle outlet openings do not have) any overlap with the axis. In an aspect, the at least one nozzle is arranged for blowing the quenching gas from an off-axis position onto the quenching region (in particular towards the center axis) at an incident angle of more than 45°, e.g. 60° to 120°, preferably 70° to 110°, more preferably 75° to 105° from the axial direction. The flow direction is defined by the main or average flow at the nozzle outlet.

Likewise, the predominantly axial direction of the flow away from the stagnation point is defined by a main or average flow directed substantially along the axis, with an angle of less than 45°, preferably less than 30° with respect to the axis.

In an aspect of the invention, the pressurizing system is a puffer system. Therein, the pressurizing chamber is a puffer chamber, e.g. with a piston arranged for compressing the quenching gas within the puffer chamber during the current breaking operation. Thus, according to a related aspect of the invention, the nozzle system is a puffer-type nozzle system without self-blast effect. Optionally, the first or second arcing contact is movable, and the piston is movable together with the first or second arcing contact, whereas another (remaining) portion of the puffer chamber is stationary, for compressing the puffer chamber during a current breaking operation.

In an aspect of the invention, the insulation gas has a global warming potential lower than the one of $SF_6$ (e.g. over an interval of 100 years). The insulation gas may for example comprise at least one background gas component selected from the group consisting of $CO_2$, $O_2$, $N_2$, $H_2$, air, $N_2O$, in a mixture with a hydrocarbon or an organofluorine compound. For example, the dielectric insulating medium may comprise dry air or technical air. The dielectric insulating medium may in particular comprise an organofluorine compound selected from the group consisting of: a fluoroether, an oxirane, a fluoramine, a fluoroketone, a fluoroolefin, a fluoronitrile, and mixtures and/or decomposition products thereof. In particular, the insulation gas may comprise as a hydrocarbon at least $CH_4$, a perfluorinated and/or partially hydrogenated organofluorine compound, and mixtures thereof. The organofluorine compound is preferably selected from the group consisting of: a fluorocarbon, a fluoroether, a fluoroamine, a fluoronitrile, and a fluoroketone; and preferably is a fluoroketone and/or a fluoroether, more preferably a perfluoroketone and/or a hydrofluoroether, more preferably a perfluoroketone having from 4 to 12 carbon atoms and even more preferably a perfluoroketone having 4, 5 or 6 carbon atoms. In particular, the perfluoroketone is or comprises at least one of: $C_2F_5C(O)CF(CF_3)_2$ or dodecafluoro-2-methylpentan-3-one, and $CF_3C(O)CF(CF_3)_2$ or decafluoro-3-methylbutan-2-one. The insulation gas preferably comprises the fluoroketone mixed with air or an air component such as $N_2$, $O_2$, and/or $CO_2$.

In specific cases, the fluoronitrile mentioned above is a perfluoronitrile, in particular a perfluoronitrile containing two carbon atoms, and/or three carbon atoms, and/or four carbon atoms. More particularly, the fluoronitrile can be a perfluoroalkylnitrile, specifically perfluoroacetonitrile, perfluoropropionitrile ($C_2F_5CN$) and/or perfluorobutyronitrile ($C_3F_7CN$). Most particularly, the fluoronitrile can be perfluoroisobutyronitrile (according to formula $(CF_3)_2CFCN$) and/or perfluoro-2-methoxypropanenitrile (according to formula $CF_3CF(OCF_3)CN$). Of these, perfluoroisobutyronitrile is particularly preferred due to its low toxicity.

In an aspect of the invention, the rated voltage of the switch is at most 52 kV. This rated voltage may also be reflected in a pressure regime and dimensions of the switch such as the values given in the following.

In an aspect of the invention, the pressurizing system is configured for pressurizing the quenching gas during the current breaking operation to a quenching pressure $p_{quench}$ satisfying at least one of the following four conditions (i. ii. iii. iv.):

$$p_{quench}<1.8*p_0, \quad \text{i.}$$

more preferably $p_{quench}<1.5*p_0$, more preferably $p_{quench}<1.3*p_0$;

$$p_{quench}>1.01*p_0, \quad \text{ii.}$$

in particular $p_{quench}>1.1*p_0$;

$$p_{quench}<p_0+800 \text{ mbar}, \quad \text{iii.}$$

in particular $p_{quench}<p_0+500$ mbar, more preferably $p_{quench}<p_0+300$ mbar, and most preferably $p_{quench}<p_0+100$ mbar, $$p_{quench}>p_0+10 \text{ bar}. \quad \text{iv.}$$

It is emphasized that already each of these four conditions alone is favourable in itself, but may advantageously be fulfilled in various combination(s) (e.g. i. and ii., or i. and iii., or ii. and iii. and iv., or all together) to improve or optimize the subsonic gas flow pattern in the load break switch.

A pressure difference below the limits of condition i and iii allows not only for a subsonic flow pattern of the quenching gas, but also keeps low the requirements, and hence the cost, of the drive of the switch. The limits of conditions i-iii nevertheless still allow for reasonable arc extinguishing properties within the ratings of a low- or medium load break switch, as long as the nozzle design described herein is used. Typically, the ambient pressure $p_0$ in the load break switch is $p_0<=3$ bar, preferably $p_0<=1.5$ bar, more preferably $p_0<=1.3$ bar.

In an aspect of the invention, the switch has one or more of the following dimensions:

The nozzle has a diameter in a range of 5 mm to 15 mm;

The pressurizing volume or pressurizing chamber has a (radial) diameter in a range of 40 mm to 80 mm, and a maximum (axial) length in a range of 40 mm to 200 mm;

The first and second arcing contacts have a maximum contact separation of up to 150 mm, preferably up to 110 mm, and/or of at least 10 mm; and in particular have a maximum contact separation in a range of 25 mm to 75 mm.

In an aspect of the invention, the nozzle comprises an insulating outer nozzle portion, e.g. at a distant tip of the nozzle.

In an aspect of the invention, at least one of the first contact and the second contact has a respective hollow section arranged such that a portion of the quenching gas having been blown onto the quenching region flows from the quenching region into the hollow section. The respective contact may, for example, have a tube-like topology, and the hollow section is then the inner tube volume. In an aspect, the hollow section has an outlet at an exit side of the hollow section, e.g. at a tube portion away from the quenching volume. The outlet may be connected to a bulk volume (ambient-pressure region) of the housing volume. Thereby, the hollow section may allow the quenching gas having flown into the hollow section to flow out at the outlet into the ambient-pressure region. Preferably both the first and second contact have such a geometry, respectively. Thereby, the arc can be dissipated particularly effectively with little energy input. According to a further aspect of the invention, both the first and second contact (pin and tulip contact) have one or more holes in their side serving as outlet, the one or more holes being preferably connected to the bulk volume.

According to a further aspect of the invention, the load break switch is of single-motion type, with only one of the first and second contact being movable. The movable contact is driven by a drive unit. According to a further aspect of the invention, the first contact (e.g. pin contact) is fixed, and the second contact (e.g. tulip contact) is movable.

According to a further aspect of the invention, the nozzle system is fixedly joined to the movable contact and/or co-moveable with the movable contact and/or driven by the drive unit which drives the movable contact.

According to a further aspect of the invention, one of the first and second contact is a tulip contact, and the (or each) nozzle of the nozzle system is arranged radially outside of the tulip contact. According to a further aspect of the invention, the inner side of the nozzle is formed by an outer side of the tulip. According to a further aspect of the invention, the outer side of the nozzle has an insulating portion, the insulating portion preferably being a tip portion of the nozzle.

According to a further aspect of the invention, the load break switch further comprises at least one of first and second field controlling elements for electrically screening the first and/or second contact, respectively. The field controlling elements are different from the nozzle system and are preferably arranged in a spaced-apart manner from the nozzle, e.g. axially distal from the nozzle and/or radially outside of the nozzle.

According to a further aspect, the second arcing contact includes a hollow pipe with an insert attached to the inside of the pipe, wherein the nozzle system comprises a channel extending from the pressurizing system to the nozzle and, in particular, being defined by the space between the insert and the hollow pipe, and wherein optionally the pressurizing system is arranged at an outside of the hollow pipe, and wherein optionally the hollow pipe comprises an opening allowing the quenching gas to pass from the pressurizing system to the channel.

According to a further aspect of the invention, a distribution network, ring main unit, or secondary distribution gas-insulated switchgear is provided, having a load break switch as described herein. In embodiments thereof, the load break switch is arranged in combination with a circuit breaker, in particular in combination with a vacuum circuit breaker.

According to a further aspect of the invention, a use of the load break switch disclosed herein in a distribution network, ring main unit, or secondary distribution gas-insulated switchgear is claimed. Use embodiments comprise: using the load break switch for breaking load currents in the distribution network, the ring main unit (RMU) or the secondary distribution gas-insulated switchgear (GIS); and/or for switching load currents, but not for interrupting short-circuit-currents; and/or using the load break switch in combination with a circuit breaker, in particular with a vacuum circuit breaker, which is different from the load break switch. As another embodiment and to be mentioned for completeness, it is also possible that inside a (specific) ring main unit there is a load break switch arranged without additional circuit breaker.

DETAILED DESCRIPTION OF DRAWINGS

Within the following description of embodiments shown in the drawings, the same reference numbers refer to the same or to similar components. Generally, only the differences with respect to the individual embodiments are described. Unless specified otherwise, the description of a part or aspect in one embodiment applies to a corresponding part or aspect in another embodiment, as well.

Figure 1B:
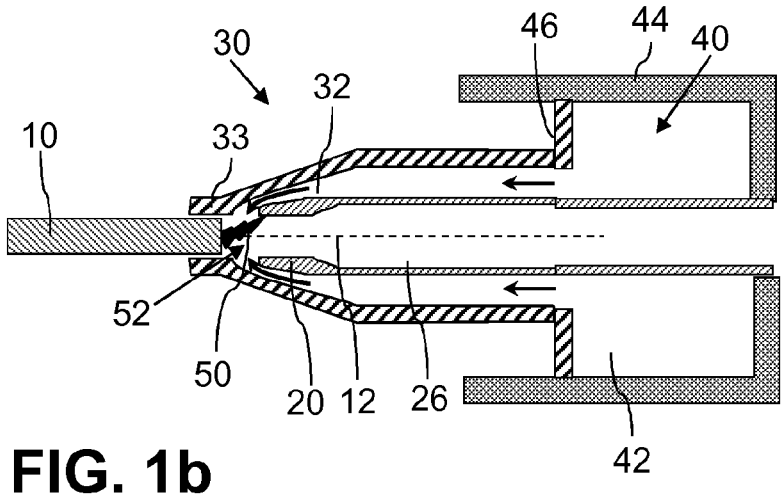
Figure 1C:
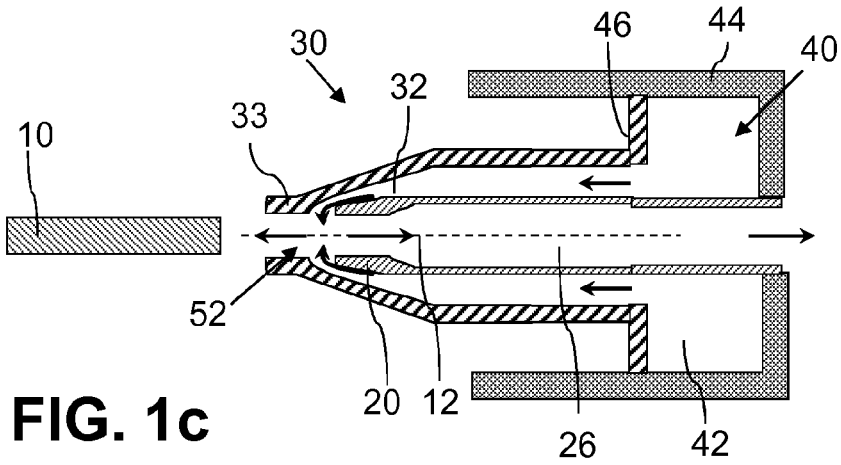

FIGS. 1*a*-1*c* show a cross-sectional view of a medium-voltage load break switch 1 according to an embodiment of the invention. In FIG. 1*a*, the switch is shown in a closed state, in FIG. 1*b* in a first state during the current breaking operation with an arc burning, and in FIG. 1*c* in a second, later state during the current breaking operation.

The switch 1 has a gas-tight housing (not shown) which is filled with an electrically insulating gas at an ambient pressure $p_0$. The shown components are arranged within the housing volume filled with the gas. In other words, ambient pressure $p_0$ signifies the background pressure filled into and being present inside the load break switch 1.

The switch 1 has a stationary pin contact (first arcing contact) 10 and a movable tulip contact (second arcing contact) 20. The fixed contact 10 is solid, while the movable contact 20 has a tube-like geometry with a tube portion 24 and an inner volume or hollow section 26. The movable contact 20 can be moved along the axis 12 away from the stationary contact 10 for opening the switch 1.

The switch 1 further has a puffer-type pressurizing system 40 with a pressurizing chamber 42 having a quenching gas contained therein. The quenching gas is a portion of the insulation gas contained in the housing volume of the switch 1. The pressurizing chamber 42 is delimited by a chamber wall 44 and a piston 46 for compressing the quenching gas within the puffer chamber 42 during the current breaking operation.

The switch 1 further has a nozzle system 30. The nozzle system 30 comprises a nozzle 33 connected to the pressurizing chamber 42 by a nozzle channel 32. The nozzle 33 is arranged off-axis with respect to the center axis 12 (and, in other words, is arranged co-axially with the center axis 12), and more specifically is arranged axially outside the tulip contact 20. In the embodiment of FIGS. 1*a*-1*c*, there are several nozzles arranged at regular angular intervals (or azimuthal positions) along a circle about the axis 12; the term "nozzle" herein refers to any one of these nozzles, and preferably to each of the nozzles.

During a switching operation, as shown in FIG. 1*b*, the movable contact 20 is moved by a drive (not shown) along the axis 12 away from the stationary contact 10 (to the right in FIG. 1*b*). Thereby, the arcing contacts 10 and 20 are separated from one another, and an arc 50 forms in the quenching region 52 between both contacts 10 and 20.

The nozzle system 30 and the piston 46 are moved by a drive (not shown), during the switching operation, together with the tulip contact 20 away from the pin contact 10. The other chamber walls 44 of the pressurizing volume 42 are stationary. Thus, the pressurizing volume 42 is compressed and the quenching gas contained therein is brought to a quenching pressure $p_{quench}$, which is defined as the maximum total pressure (overall, i.e. neglecting localized pressure build-up) within the pressurizing chamber 42.

The nozzle system 30 then blows the pressurized quenching gas from the pressurization chamber 42 onto the arc 50, as indicated by the arrows in FIG. 1*b*. To this purpose, the quenching gas from the pressurization chamber 42 is released and blown through the channel 32 and the nozzle 33 onto the arcing zone 52.

The nozzle 33 defines the flow pattern of the quenching gas, indicated in FIGS. 1*b* and 1*c*: The quenching gas flows from an off-axis position (the nozzle outlet of the nozzles 33) predominantly radially inwardly onto the quenching region 52 and thus onto the arc 50.

The predominantly radially-directed inward flow, as defined by the at least one nozzle 33, can in a preferred aspect be described as the nozzle 33 being arranged for blowing the quenching gas from an off-axis position onto the quenching region 52 at an incident angle of between 75° and 105° from the axial direction.

Figure 2:
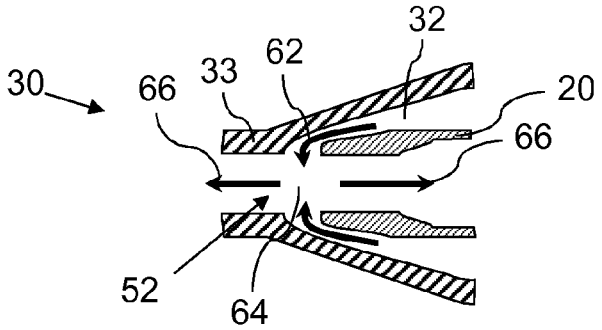
FIG. 2 shows in more detail the flow pattern of the quenching gas during a current breaking operation of the load break switch of FIGS. 1*a*-1*c*.

FIG. 2 shows the flow pattern of the quenching gas in more detail. The flow pattern includes a stagnation point 64, at which the flow of quenching gas essentially stops. More precisely, the stagnation point 64 is defined as the region in which the flow pattern of the quenching gas has an essentially vanishing velocity. In quantitative terms, the velocity of the gas essentially vanishes, if the magnitude $v_{gas}$ of the gas velocity satisfies the inequality $$v_{gas} \leq c\sqrt{2\Delta p/\rho}$$

wherein $\Delta p = p_{quenching} - p_0$ is the pressure difference of the pressurized (quenching) gas (maximum pressure $p_{quenching}$ in the pressurizing volume 42) and the ambient gas (bulk pressure $p_0$); $\rho$ is the gas density of the pressurized (quenching) gas in the compression volume (at maximum compression), and c is a predetermined constant coefficient preferably selected in a range $c<0.2$, for example $c=0.01$, preferably $c=0.1$.

Herein, the stagnation point 64 is defined as the region, in which the above inequality is met during steady-state flow of the quenching gas during an arc-free operation, e.g. during an opening movement of the switch without current (no-load operation). The above inequality is preferably defined in the absence of an arc (in particular without an arc generating current).

The stagnation point 64 thus describes a region. In addition, the stagnation point 64 may also refer to any point within this region, and in particular refers to a center of this region.

The flow pattern further includes an upstream region 62 of (predominantly radial inward) flow towards the stagnation point 64, i.e. upstream of the stagnation point 64, and a downstream region 66 of accelerating flow in a predominantly axial direction away from the stagnation point 64, i.e. downstream of the stagnation point 64. Here, "upstream" and "downstream" does not necessarily imply that the gas has traveled though the stagnation point 64.

Preferably the stagnation point 64 overlaps with the arcing region 52, and more preferably is located within the arcing region 52.

Thus, the quenching gas flows (in the upstream region 62) towards the arcing zone 52 from a predominantly radial direction, whereby it decelerates. From the arcing zone 52, the gas flows (in the downstream region 66) in a predominantly axial direction away from the arcing zone, whereby it accelerates axially. This flow pattern has the advantage of creating a pressure profile by which the cross section and diameter of the arc 50 are constrained and kept small. This, and the axial blowing onto the arc 50, leads to enhanced cooling and extinguishing of the arc 50.

In the embodiment shown in FIGS. 1*a*-1*c* and 2, the gas accelerates, downstream of the stagnation point 62, in two opposite directions along the axis 12: The nozzle system defines two downstream regions 66 on opposite sides of the stagnation point 64 along the axis 12. This double flow from the arc 50 is enabled by a hollow volume or hollow section 26 of the second contact 20. The hollow section 26 is arranged such that a portion of the quenching gas having been blown onto the quenching region 52 is allowed to flow from the quenching region 52 into the hollow section 26, and from there though an outlet of the hollow section 26 (in FIGS. 1*a*-1*c* at the right side of the hollow section 26) into the bulk housing volume of the load break switch 1.

The load break switch 1 comprises also other parts such as nominal contacts, a drive, a controller, and the like, which have been omitted in the Figures and are not described herein. These parts are provided in analogy to conventional low- or medium-voltage load break switches.

The load break switch may be provided as a part of a gas insulated ring main unit, and may be rated for switching a load current in the range of up to 400 A, or even up to 2000 A (rms).

Some possible applications for the load break switch are a low- or medium voltage load break switch and/or a switch-fuse combination switch; or a medium-voltage disconnector in a setting in which an arc cannot be excluded. The rated voltage for these application is at most 52 kV.

By applying the flow pattern described herein to a low- or medium-voltage load break switch, its thermal interruption performance can significantly be improved. This permits, for example, the use with an insulation gas being different from $SF_6$. $SF_6$ has excellent dielectric and arc quenching properties, and has therefore conventionally been used in gas-insulated switchgear. However, due to its high global warming potential, there have been large efforts to reduce the emission and eventually stop the usage of such greenhouse gases, and thus to find alternative gases, by which $SF_6$ may be replaced.

Such alternative gases have already been proposed for other types of switches. For example, WO 2014/154292 A1 discloses an $SF_6$-free switch with an alternative insulation gas. Replacing $SF_6$ by such alternative gases is technologically challenging, as $SF_6$ has extremely good switching and insulation properties, due to its intrinsic capability to cool the arc.

The present configuration allows the use of such an alternative gas having a global warming potential lower than the one of $SF_6$ in a load break switch, even if the alternative gas does not fully match the interruption performance of $SF_6$.

The insulation gas preferably has a global warming potential lower than the one of $SF_6$ over an interval of 100 years. The insulation gas preferably comprises at least one gas component selected from the group consisting of $CO_2$, $O_2$, $N_2$, $H_2$, air, $N_2O$, a hydrocarbon, in particular $CH_4$, a perfluorinated or partially hydrogenated organofluorine compound, and mixtures thereof.

The organofluorine compound is preferably selected from the group consisting of: a fluorocarbon, a fluoroether, a fluoroamine, a fluoronitrile, a fluoroketone, and a mixture and/or decomposition product thereof, and preferably is a fluoroketone and/or a fluoroether, more preferably a perfluoroketone and/or a hydrofluoroether, most preferably a perfluoroketone having from 4 to 12 carbon atoms. The insulation gas preferably comprises the fluorketone mixed with air or an air component such as $N_2$, $O_2$, $CO_2$.

In some embodiments, due to the flow profile that allows the arc to be cooled very effectively, this improvement can be achieved without increasing the pressure build-up of the quenching gas in the nozzle (without increased pressure of the puffer chamber), and thus without increased demand/cost for the drive of the switch. In some embodiments, the pressure build-up may even be reduced.

Thus, in an aspect of the invention, the pressurizing system 40 may be configured for pressurizing the quenching gas during the current breaking operation to a quenching pressure $p_{quench}<1.8*p_0$, wherein $p_0$ is the ambient (equilibrium) pressure of the insulation gas in the bulk volume of the housing, and $p_{quench}$ is the (maximum overall) pressure of the pressurized insulation gas, also referred to as quenching gas, during the current breaking operation in the pressurizing chamber. This condition on the quenching pressure ensures that the flow of quenching gas is subsonic, and at the same time limits the requirement of the drive, which usually delivers the work of pressurizing the quenching gas.

More preferably, the quenching pressure satisfies $p_{quench}<1.5*p_0$ or $p_{quench}<1.3*p_0$ or even $p_{quench}<1.1*p_0$. On the other hand, the quenching pressure preferably satisfies $p_{quench}>1.01*p_0$, so that the pressure build-up is sufficient for extinguishing the arc.

In another aspect, the quenching pressure satisfies $p_{quench}<p_0+800$ mbar, preferably $p_{quench}<p_0+500$ mbar, more preferably $p_{quench}<p_0+300$ mbar, and even more preferably $p_{quench}<p_0+100$ mbar. On the other hand, quenching pressure preferably satisfies $p_{quench}>p_0+10$ mbar.

In embodiments, the ambient pressure of the (bulk) insulation gas in the housing $p_0$ is <=3 bar, more preferably $p_0$<=1.5 bar, and even more preferably $p_0$<=1.3 bar.

These pressure conditions are very different from typical flow conditions in high-voltage circuit breakers (rated voltage much above 52 kV). In these high-voltage circuit breakers (buffer and self-blast type), the flow conditions are supersonic in order to maximize the cooling of the arc. Thereby, a much higher pressure built-up, $p_{quench}$ considerably above $1.8*p_0$ (and considerably above $p_0+800$ mbar), is required. This imposes strong requirements on the drive of these high-voltage circuit breakers, which are disadvantageous or even prohibitive, from a cost standpoint, for the low- and medium load breakers considered here. These low- and medium load breakers are a completely different type of switch for completely different applications, design and market than circuit breakers.

In contrast, the present application is directed to a low- or medium-voltage load break switch, which is typically rated to voltages of at most 52 kV and not rated for or is incapable of switching higher voltages, and which is rated to currents of at most 2000 A or even at most 1250 A and not rated for or is incapable of switching higher currents. In particular, a load break switch is not rated for or is incapable of interrupting a fault current. Specifically, the load break switch is not rated for or is incapable of interrupting a short-circuit current.

Figure 3:
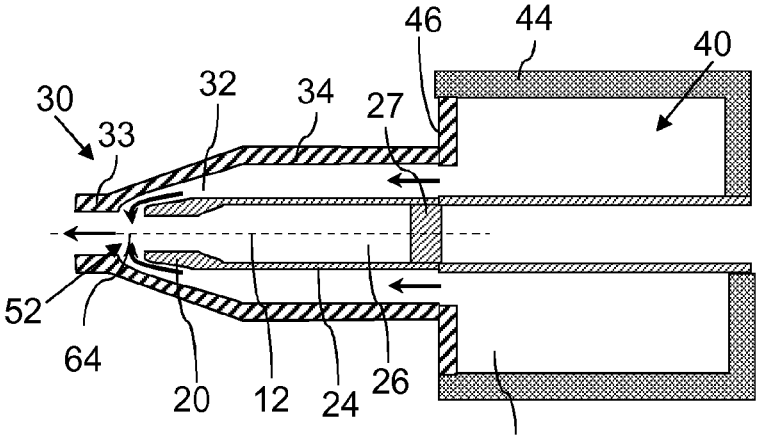
FIG. 3 shows a cross-sectional view of a load break switch according to a further embodiment of the invention.

Next, with reference to FIG. 3, a load break switch according to a further embodiment of the invention is described. The embodiment differs from that of FIGS. 1*a*-1*c* in that the hollow section 26 of the second contact 20 is blocked by a blocking element 27. As a result, the hollow section 26 does not allow a flow of quenching gas therethrough. Therefore, in the embodiment of FIG. 3, the quenching gas accelerates, downstream of the stagnation point 64 (in the quenching region 52), in only one direction along the axis 12, namely towards the other contact (first contact, not shown in FIG. 3), i.e. to the left in FIG. 3. Nevertheless, due to the predominantly axial inflow of the quenching gas towards the quenching region 52, the gas flow still exhibits a stagnation point 64.

The other aspects of the embodiment of FIG. 3 are analogous to that of FIGS. 1*a*-1*c* and 2, and the above description thereof applies likewise to the embodiment of FIG. 3.

Figure 4:
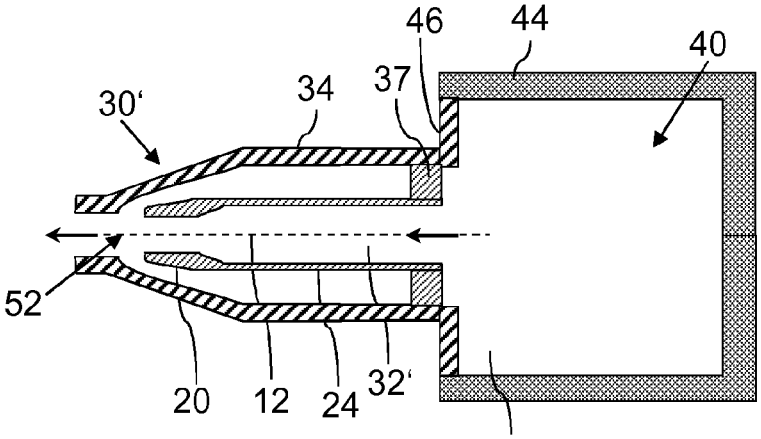
FIG. 4 shows a cross-sectional view of a load break switch according to a comparative example.

With reference to FIG. 4, a conventional load break switch according to a comparative example is described. Therein, the quenching gas is blown, through a channel 32' extending along the axis 12 and through an axially arranged nozzle (center of the tulip constituting the second contact 20), onto the arcing region 52 in an axial direction. This flow pattern defines a predominantly axial flow without a stagnation point. In this embodiment of FIG. 4, this is achieved by connecting the axial channel 32' with the pressurizing volume 42 and by blocking any non-axial channel e.g. by a blocking element 37.

In the comparative path of FIG. 4, the quenching gas is blown onto the arc from a predominantly axial direction, in particular from the center of the tulip (second contact) 20. Correspondingly, the arc is caused to move out from the nozzle 33 through the exhaust (here to the left side in FIG. 4). This conventional flow topology of FIG. 4, also referred to as axial flow, has been used in prior art load break switches. It is simple and cheap to implement, and produces acceptable arc extinguishing performance with $SF_6$ gas and 100 mbar-200 mbar of pressure build-up.

The performance of the different designs of FIGS. 1*a* to 4 has been compared experimentally. Namely, a load current was applied though the first and second contacts 10 and 20, and the plug (first contact 10) was moved relatively to and separate from the second contact 30, whereby an arc was ignited. At the same time, the quenching gas was pressurized and released from the pressurizing volume 42 to flow to the arcing region 52 for extinguishing the arc 50, as described above for the respective FIGS. 1*b*-1*c*, 2, 3 and 4.

As a result, it was found that for extinguishing the same level of interruption current, the embodiments of the invention (FIGS. 1*a*-3) required a much smaller pressure (overpressure in the pressurizing volume) compared to the conventional design of FIG. 4.

Similarly, it was found that with a given pressure build-up as for the conventional switch (FIG. 4) using $SF_6$ as quenching gas, the flow profile of FIGS. 1*a*-3 still allows to thermally interrupt the current, even if an alternative gas having a reduced arc-quenching potential is used as the quenching gas. As a remark, it is thus clear that the load break switch described herein can also be used with $SF_6$ as quenching gas.

These results clearly show the advantages brought about by the change in the nozzle design and the quenching gas flow pattern according to the present invention. This optimized nozzle design allows a much more efficient arc cooling and quenching efficiency compared with the conventional design, and thus enables to thermally interrupt the load currents for a wide range of possible ratings of load break switches (e.g. for rated currents up to voltages of e.g. 12 kV, up to 24 kV, up to 36 kV, or even up to 52 kV) by an alternative quenching gas as mentioned herein.

Next, a load break switch according to a further embodiment of the invention is described. Again, the description of any other embodiment may also apply to this embodiment, unless specified otherwise. In this embodiment, the first contact is a pin, and the second (moving) contact is a tulip-type contact which includes a hollow pipe with an insert attached to the inside of the pipe. The nozzle system comprises a nozzle and a nozzle channel defined between the pipe and the insert. The nozzle is arranged for blowing the quenching gas from an off-axis position predominantly radially inwardly onto the quenching region, as already described with respect to FIGS. 1*a*-1*c* and 2. Differently from these Figures, the pressurizing volume is radially outside of the nozzle channel and/or from a pipe defining an inlet from the pressurizing volume to the nozzle channel. Holes in the side of the nozzle channel or pipe define an inlet from the pressurizing volume to the nozzle channel.

With this embodiment, the current breaking operation is performed analogously to FIG. 1*a*-1*c*: The second contact and the piston are moved, by a drive, away from the first contact, and the gas in the pressurizing volume is compressed by the piston to flow to the arcing region from an off-axis position predominantly radially inwardly towards the arc. After having reached the arcing region, the quenching gas flows in two directions (double-flow), as described above with respect to FIGS. 1*a*-1*c* and 2.

This embodiment allows the advantageous flow pattern to be realized with a minimum number of parts and a minimum increase in cost and weight of the moving contact, by merely providing the additional insert.

The invention is not limited to the embodiments shown above, but they may be modified in several ways within the scope defined by the claims. For example, FIGS. 5 to 9 show additional variations of load break switches according further embodiments of the invention. Here, only the top halves (above axis 12) of the respective switches are shown; but in general the switches are essentially rotationally symmetric. In these Figures, the reference signs again correspond to those of the earlier Figures, and their description also applies to FIGS. 5 to 9 unless specified or shown otherwise. These FIGS. 5 to 9 illustrate general aspects that can also be used in conjunction with other embodiments.

Figure 5:
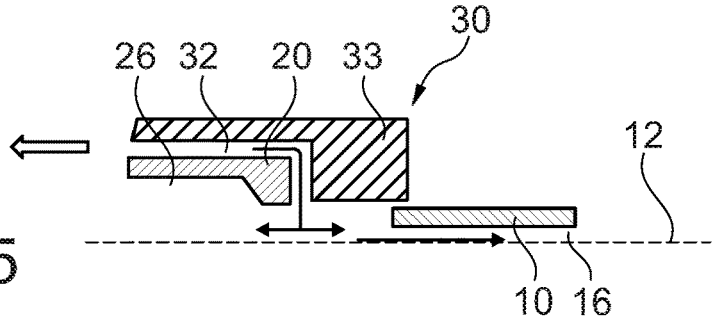
FIGS. 5 to 9 show schematic cross-sectional views of load break switches according to yet further embodiments of the invention.

FIG. 5 illustrates that a hollow plug 10 can be used as the first contact 10, so that an axial exhaust channel 16 is defined within the hollow plug 10. This design allows a more efficient flow of the quenching gas in the downstream region. This design also allows the use of long nozzles 33 (extending in an axial direction) without impairing arc quenching efficiency. This design can be applied both to a double-flow type switch (see FIGS. 1*a*-1*c* and 2) as shown in FIG. 5, or to a single-flow switch as shown in FIG. 2.

Figure 6:
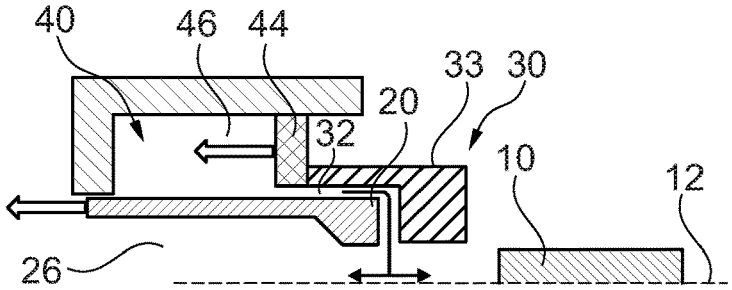

FIG. 6 illustrates that the piston 44 of the pressurizing system (puffer system) and/or the nozzle system 30 can be movable jointly with the second arcing contact 20, and in particular that the piston 44 can be attached to the nozzle system 30, and specifically to the nozzle 33. With this aspect, the second arcing contact (tulip) 20, the nozzle system 30 and the piston 44 may move together.

Figure 7:
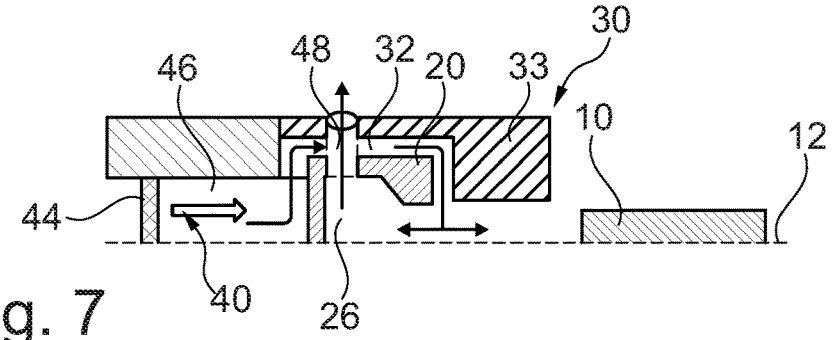

According to a general aspect, the piston 44 and the pressurizing volume 46 are arranged at an off-axis position of the switch. However, FIG. 7 illustrates that in an alternative aspect, the piston 44 and the pressurizing volume 46 can also be arranged on the axis 12 of the switch. Then, the channel 32 of the nozzle system 30 extends from the pressurizing volume 46 to the off-axis position of the nozzle 33.

FIG. 7 further illustrates that an outlet 48 from the hollow section 26 may extend predominantly radially from the on-axis hollow section 26 to the bulk volume of the switch housing.

Figure 8:
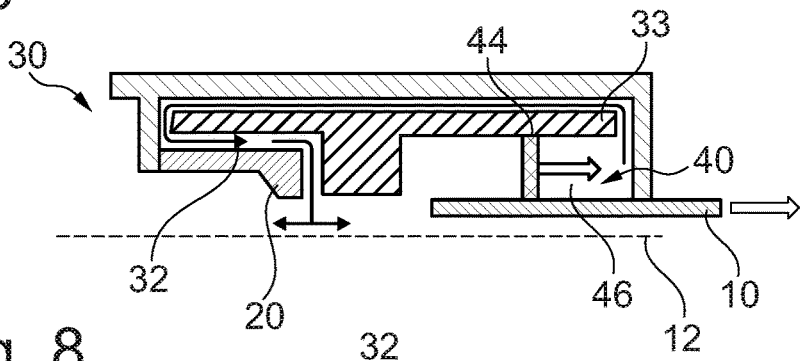

FIG. 8 illustrates in an embodiment that the second arcing contact 20 may be stationary, while the first arcing contact 10 is movable; the nozzle system 30 is stationary (attached to the second arcing contact 20); the piston is jointly movable with the first arcing contact 10; the remainder of the pressurizing system 44, 46 may be stationary. This arrangement may lead to a configuration with particularly low moving mass.

Figure 9:
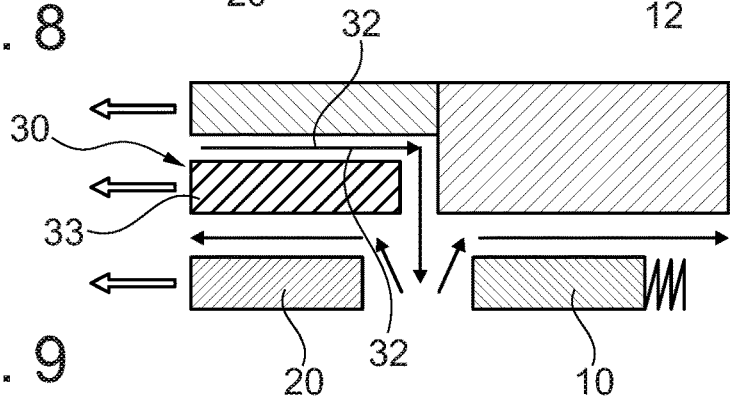

FIG. 9 illustrates in an embodiment that both arcing contacts 10 and 20 can be plugs, abutting each other in a plug-plug configuration. As another aspect, instead of being stationary, the first arcing contact 10 can be spring-mounted. The second arcing contact 20 is movable jointly with the nozzle system 30, but alternatively another configuration according to any one of the aspects described herein is possible.

In embodiments, the load break switch 1 is a knife switch; or in general the load break switch 1 has a contact system with a rotating contact. In an alternative embodiment, the load break switch 1 has one axially movable contact (single-motion type). According to a further embodiment of this, the nozzle system 30 is fixedly joined to the movable contact and/or is co-movable with the movable contact and/or is driven by the drive unit which drives the movable contact.

In embodiments, the load break switch 1 comprises nominal contacts, not shown in the figures. Typically, the nominal contacts are present radially outside of the first arcing contact 10 and of the second arcing contact 20, in particular also radially outside of the nozzle 33.

In embodiments, the load break switch 1 has a controller, in particular the controller having a network interface for being connected to a data network, such that the load break switch (1) is operatively connected to the network interface for at least one of: sending device status information to the data network and carrying out a command received from the data network, in particular the data network being at least one of: LAN, WAN or internet (IoT). Accordingly, a use of the load break switch having such a controller is disclosed, as well.

In embodiments, the load break switch 1, in particular the nozzle system 30, is designed for maintaining the subsonic flow pattern during the whole current breaking operation; and/or the load break switch 1, in particular the nozzle system 30, is designed for maintaining the subsonic flow pattern during all types of current breaking operations; and/or the load break switch 1, in particular the nozzle system 30, is designed for maintaining the subsonic flow pattern inside the load break switch 1, in particular inside the nozzle system 30 or inside the at least one nozzle 33; and/or the load break switch 1, in particular the nozzle system 30, is designed for avoiding sonic flow conditions at any instant of the current breaking operation and for every current breaking operation to be performed by the load break switch 1 (i.e. excluding interruption of fault currents or short-circuit currents).

In embodiments, the nozzle system 30 comprises a nozzle channel 32 connecting the pressurizing chamber 42 to the nozzle 33; in particular wherein the nozzle channel 32 is arranged radially outside the first or second arcing contact, and/or the nozzle channel 32 is arranged in an off-axis position in the load break switch 1.

As disclosed herein, the load break switch 1 is not a circuit breaker, in particular not a circuit breaker for high voltages above 52 kV; and/or the pressurizing system 40 is devoid of a heating chamber for providing a self-blasting effect; and/or the load break switch 1 is designed to be arranged in combination with a circuit breaker, in particular with a vacuum circuit breaker.

The invention claimed is:

1. A gas-insulated low- or medium-voltage load break switch, comprising:

a housing defining a housing volume for holding an insulation gas at an ambient pressure $p_0$;

a first arcing contact and a second arcing contact arranged within the housing volume, the first and second arcing contacts being movable in relation to each other along an axis of the load break switch and defining a quenching region in which an arc is formed during a current breaking operation;

a pressurizing system having a pressurizing chamber arranged within the housing volume for pressurizing a quenching gas to a quenching pressure $p_{quench}$ during the current breaking operation, wherein the quenching pressure $p_{quench}$ and the ambient pressure $p_0$ satisfy a relationship $p_0<p_{quench}$; and a nozzle system arranged within the housing volume for blowing the quenching gas in a subsonic flow pattern from the pressurization chamber onto the arc formed in the quenching region during the current breaking operation, wherein the load break switch is designed for maintaining the subsonic flow pattern during current breaking operations, the nozzle system comprises at least one nozzle arranged for blowing the quenching gas from an off-axis position predominantly radially inwardly onto the quenching region, and the insulation gas comprises a background gas in a mixture with an organofluorine compound selected from the group consisting of: fluoroether, oxirane, fluoroamine, fluoroketone, fluoroolefin, fluoronitrile, and mixtures and/or decomposition products thereof.

2. The load break switch according to claim 1, having a rated voltage of at most 52 kV; and/or the load break switch being rated for switching nominal currents in a range of up to 2000 A.

3. The load break switch according to claim 1, wherein the load break switch is a knife switch or wherein the load break switch has one axially movable contact.

4. The load break switch according to claim 1, wherein the nozzle system is designed for maintaining the subsonic flow pattern during the current breaking operation; and/or wherein the nozzle system is designed for maintaining the subsonic flow pattern during current breaking operations; and/or wherein the nozzle system is designed for maintaining the subsonic flow pattern inside the load break switch; and/or wherein the nozzle system is designed for avoiding sonic flow conditions at any instant of the current breaking operation and for every current breaking operation to be performed by the load break switch.

5. The load break switch according to claim 1, wherein the nozzle system comprises a nozzle channel connecting the pressurizing chamber to the nozzle.

6. The load break switch according to claim 5, wherein the nozzle channel is arranged radially outside the first or second arcing contact, and/or the nozzle channel is arranged in an off-axis position in the load break switch.

7. The load break switch according to claim 1, it being designed for breaking load currents in a distribution network, ring main unit (RMU) or secondary distribution gas-insulated switchgear (GIS); and/or the load break switch has a capability to switch load currents, but does not have a short-circuit-current interrupting capability; and wherein the load break switch further comprises nominal contacts.

8. The load break switch according to claim 1, wherein the nozzle system defines a flow pattern for the quenching gas, the flow pattern including:

a stagnation point at which a flow of quenching gas stops, an upstream region of predominantly radially inward flow towards the stagnation point, and a downstream region of accelerating flow in a predominantly axial direction away from the stagnation point.

9. The load break switch according to claim 1, wherein the pressurizing system is a puffer system and the pressurizing chamber is a puffer chamber with a piston arranged for compressing the quenching gas within the puffer chamber during the current breaking operation.

10. The load break switch according to claim 1, wherein the at least one nozzle is arranged for blowing the quenching gas from an off-axis position onto the quenching region at an incident angle of between 45° to 120° from an axial direction.

11. The load break switch according to claim 1, wherein the insulation gas has a global warming potential lower than the global warming potential of $SF_6$ over an interval of 100 years, and wherein the insulation gas comprises at least one gas component selected from the group consisting of: $CO_2$, $O_2$, $N_2$, $H_2$, air, $N_2O$, a hydrocarbon.

12. The load break switch according to claim 1, wherein the background gas is selected from the group consisting of: $CO_2$, $O_2$, $N_2$, $H_2$, air, in a mixture with the organofluorine compound.

13. The load break switch according to claim 1, wherein the pressurizing system is configured for pressurizing the quenching gas during the current breaking operation to a quenching pressure $p_{quench}$ satisfying at least one of the following conditions:

$$p_{quench}<1.8\cdot p_0 \quad \text{i.}$$

$$p_{quench}>1.01\cdot p_0 \quad \text{ii.}$$

$$p_{quench}<p_0+800\text{ mbar} \quad \text{iii.}$$

$$p_{quench}>p_0+10\text{ bar} \quad \text{iv.}$$

14. The load break switch according to claim 1, having a rated voltage of at least 1 kV; and/or the load break switch being rated for currents of more than 1 A; and/or the ambient pressure $p_0$ in the load break switch is $p_0<=3$ bar.

15. The load break switch according to claim 1, wherein the nozzle comprises an insulating outer nozzle portion; and/or wherein the load break switch has one or more of the following dimensions:

the nozzle has a diameter in a range of 5 mm to 15 mm, the pressurizing chamber has a radial diameter in a range of 40 mm to 80 mm, and a maximum axial length in a range of 40 mm to 200 mm;

the first arcing contact and the second arcing contact have a maximum contact separation of up to 150 mm.

16. The load break switch according to claim 15, wherein at least one of the first contact and the second contact has a hollow section that has an outlet for allowing the quenching gas having flown into the hollow section to flow out at an exit side of the hollow section into an ambient-pressure region of the housing volume of the load break switch.

17. The load break switch according to claim 1, wherein at least one of the first contact and the second contact has a respective hollow section arranged such that a portion of the quenching gas having been blown onto the quenching region flows from the quenching region into the hollow section.

18. The load break switch according to claim 1, wherein the load break switch has a controller, the controller having a network interface for being connected to a data network, such that the load break switch is operatively connected to the network interface for at least one of: sending device status information to the data network and carrying out a command received from the data network, and wherein the data network being at least one of: LAN, WAN or internet (IoT).

19. The load break switch according to claim 1, wherein the load break switch is not a circuit breaker; and/or the pressurizing system is devoid of a heating chamber for providing a self-blasting effect; and/or the load break switch is designed to be arranged in combination with a circuit breaker.

20. A distribution network, ring main unit, or secondary distribution gas-insulated switchgear having the load break switch according to claim 1.

21. A method of breaking a load current using the load break switch according to claim 1, the method comprising:

moving the first arcing contact and the second arcing contact relatively away from each other along the axis of the load break switch, whereby the arc is formed in the quenching region;

pressurizing the quenching gas to the quenching pressure $p_{quench}$ satisfying a condition $p_0<p_{quench}$, wherein $p_0$ is the ambient pressure inside the load break switch (1); and blowing, via the nozzle system, the quenching gas in the subsonic flow pattern from the pressurization chamber onto the arc formed in the quenching region, wherein the subsonic flow pattern in maintained during current breaking operations, thereby blowing the quenching gas from the off-axis position predominantly radially inwardly onto the quenching region.

22. The method of claim 21, wherein a flow pattern for the quenching gas is defined by the nozzle system, the flow pattern including information of:

a stagnation point at which a flow of quenching gas stops, an upstream region of predominantly radially inward flow towards the stagnation point, and a downstream region of accelerating flow in a predominantly axial direction away from the stagnation point.

23. The method of claim 21, wherein the quenching gas is pressurized during the current breaking operation to a quenching pressure $p_{quench}$ such that at least one of the following four conditions is fulfilled:

$$p_{quench}<1.8\cdot p_0; \quad \text{i.}$$

$$p_{quench}>1.01\cdot p_0; \quad \text{ii.}$$

$$p_{quench}<p_0+800\text{ mbar}, \quad \text{iii.}$$

$$p_{quench}>p_0+10\text{ bar}. \quad \text{iv.}$$

24. The method of claim 21, wherein the subsonic flow pattern is maintained during the current breaking operation; and/or wherein the subsonic flow pattern is maintained inside the load break switch; and/or wherein sonic flow conditions are avoided at any instant of the current breaking operation and for every current breaking operation to be performed by the load break switch.

* * * * *